United States Patent [19]

Johnson

[11] 4,040,181

[45] Aug. 9, 1977

[54] LOCKING BLADE KNIFE

[75] Inventor: Lawrence P. Johnson, Boulder, Colo.

[73] Assignee: Western Cutlery Co., Boulder, Colo.

[21] Appl. No.: 720,773

[22] Filed: Sept. 7, 1976

[51] Int. Cl.[2] ..... B26B 1/02

[52] U.S. Cl. ..... 30/161

[58] Field of Search ..... 30/160, 161, 159

[56] References Cited

U.S. PATENT DOCUMENTS

| | | | |
|---|---|---|---|
| 1,362,142 | 12/1920 | Rohrer | 30/161 |
| 2,808,646 | 10/1957 | Lohr | 30/159 |
| 3,568,315 | 3/1971 | Smith | 30/161 |
| 3,783,509 | 1/1974 | Lake | 30/161 |

*Primary Examiner*—Al Lawrence Smith
*Assistant Examiner*—J. C. Peters

[57] ABSTRACT

The knife of the invention comprises a handle including a pair of side scales held in spaced parallel relation by a pair of end pins and a center pin, to provide a narrow elongate channel, a single folding blade pivoted on the forward end pin and a rigid locking rocker arm pivoted on the center pin for rocking movement in the channel. The blade has a key notch in the back of the tang and the forward end of the rocker arm has a key to engage the notch and lock the blade in extended position. An aperture through the aft portion of the rocker arm cooperates with the side scales to form a totally enclosed pocket through which the aft end pin passes, and a spring totally enclosed within the pocket engages the pin and the wall of the aperture to urge the arm into locking position. A recess in the back of the handle facilitates pressing the aft portion of the arm inward to release the blade for retraction. The totally enclosed pocket excludes dirt and ensures positive operation of the spring. The rocker arm is flush with the back of the handle and gives the appearance of a conventional non-locking pocket knife.

9 Claims, 5 Drawing Figures

LOCKING BLADE KNIFE

BACKGROUND OF THE INVENTION

This invention lies in the field of knives and is directed to those of the folding blade type suitable for carrying in the pocket. It is more particularly directed to such knives which have means for locking the blades in extended position for greater safety in use.

Foldable locking blade knives have been made and used for many years and innumerable designs have been proposed for accomplishing positive locking and ease of locking and unlocking. Most of these designs are generally satisfactory when the knives are new or have been kept clean at all times. However, many of them have various sharp edges which catch on clothing or may cut the hands in use and they do not have a neat uncluttered appearance like a conventional non-locking pocket knife. The principal defect or disadvantage of these prior art designs is that the operating parts of the locking mechanisms are wide open to the exterior. Such knives are used primarily by campers, hunters and fishermen, and sand, wood chips, and other debris quickly work in between the parts, including the spring components, and interfere with proper operation. The gaps are frequently small and inaccessible so that it is extremely difficult to clean them.

SUMMARY OF THE INVENTION

The article of the present invention overcomes the difficulties mentioned above and provides a folding locking blade pocket knife which has a minimum number of components, a totally enclosed and protected spring mechanism, and no protruding elements which can damage the person or clothing.

Generally stated, the knife comprises a handle of generally conventional form including a pair of side scales arranged in spaced parallel relation to form a long narrow channel, and held in such relation by a pair of end pins and a center pin. A single knife blade has an apertured tang which is pivotally mounted on the forward end pin within the channel to provide for swinging of the blade between the extended operating position and a retracted position in the channel. The back of the tang is formed with a key notch to receive a locking key for positively retaining the blade in extended position.

A rigid locking rocker arm is arranged in the channel and extends along the back of the handle throughout the major portion of the length of the handle and it is pivotally mounted intermediate its ends on the center pin for rocking movement in the handle. The forward end of the arm is formed with an inwardly facing key to engage the notch in the tang when the blade is in extended position and lock the blade against retraction.

The aft position of the rocker arm is formed with an aperture of predetermined size and shape throughout the thickness of the arm and the aperture is so located that the aft pin passes through it. The thickness of the rocker arm is preferably uniform throughout, and the thickness is so chosen that the arm fits in sliding relation with the side scales. Hence, the scales and the periphery of the aperture cooperate to produce a totally enclosed pocket within the handle. A spring is located in the pocket in engagement with the end pin and a portion of the periphery of the aperture and is biased to yieldingly urge the aft end of the arm in a direction outwardly of the back of the handle, thus forcing the key into locking engagement with the notch. With this construction it will be apparent that dirt or debris of any kind is excluded from the vicinity of the spring biasing mechanism and cannot interfere with the smooth and reliable operation of the locking mechanism.

The rocker arm is so dimensioned and mounted that its outer edge is substantially flush with the back of the handle whether the blade is extended or retracted. In the presently preferred form the arm extends to the extreme aft end of the handle and forms a part of the contour of the aft end. Thus it presents a smooth uncluttered appearance and gives the effect of a conventional non-locking pocket knife.

A recess is formed in the aft portion of the back of the handle wide enough to receive a man's thumb, so that the portion of the arm which crosses the recess may be readily depressed to swing the arm to unlocking position. The handle is finished in the usual fashion with side covers and bolsters to provide the complete package which is simple and neat and looks like a conventional pocket knife.

BRIEF DESCRIPTION OF THE DRAWING

Various other advantages and features of novelty will become apparent as the description proceeds in conjunction with the accompanying drawings, in which.

DESCRIPTION OF PREFERRED EMBODIMENTS

Figure 1:
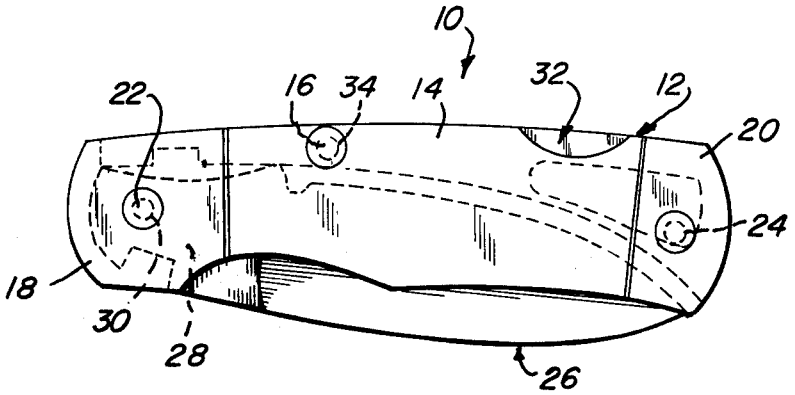
FIG. 1 is a side elevational view of the complete knife with the blade in closed position.

The complete knife 10 with the blade in retracted position is illustrated in FIG. 1, in which handle 12 is provided with side covers 14 held in position by a center pin 16 and fore and aft bolsters 18 and 20 held in position by fore and aft end pins 22 and 24. The blade 26 has a tang 28 apertured at 30 for pivotal mounting on pin 22, and rocker arm 32 is apertured at 34 for pivotal mounting on pin 16.

Figure 2:
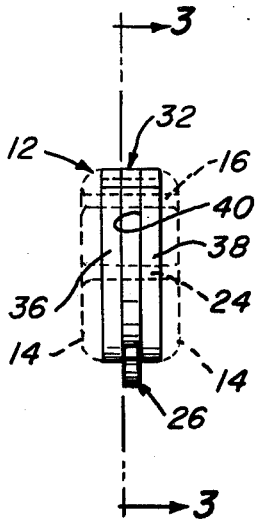
FIG. 2 is an end elevational view of the knife looking at the aft ends.

In FIG. 2 it will be seen that a pair of side scales 36 and 38 are arranged in parallel spaced relation to provide a narrow elongate channel 40 and are secured in fixed relation by the center pin and the end pins. Rocker arm 32 is pivotally mounted on center pin 16 and is located in channel 40. It is of substantially uniform thickness from end to end and the thickness is so chosen that it has a snug sliding fit between the inner faces of the scales 36 and 38 so as to exclude any sand, wood chips, or other debris from the interior of the handle and the relatively working parts to be described.

Figure 3:
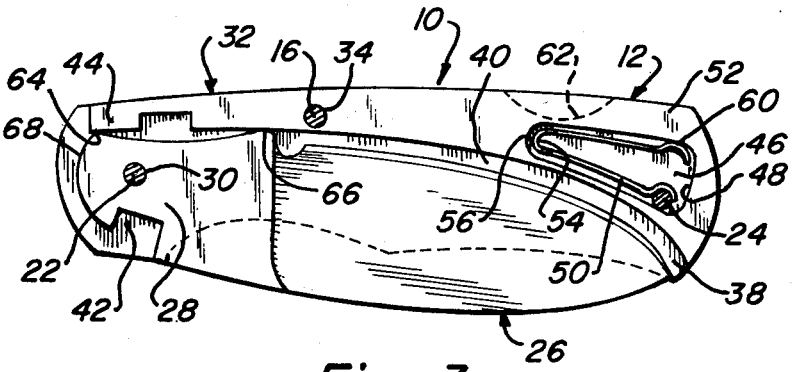
FIG. 3 is a sectional view taken on line 3—3 of FIG. 2.
Figure 4:
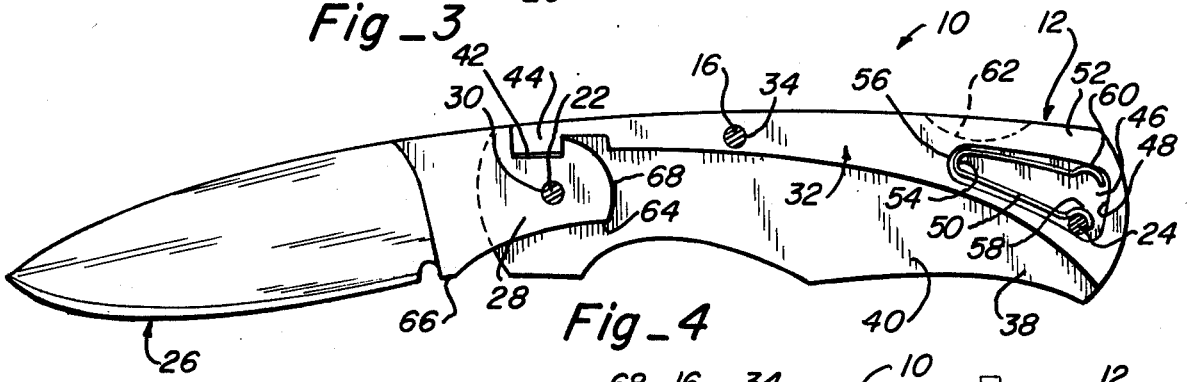
FIG. 4 is a view similar to FIG. 3 but with the blade in extended position.
Figure 5:
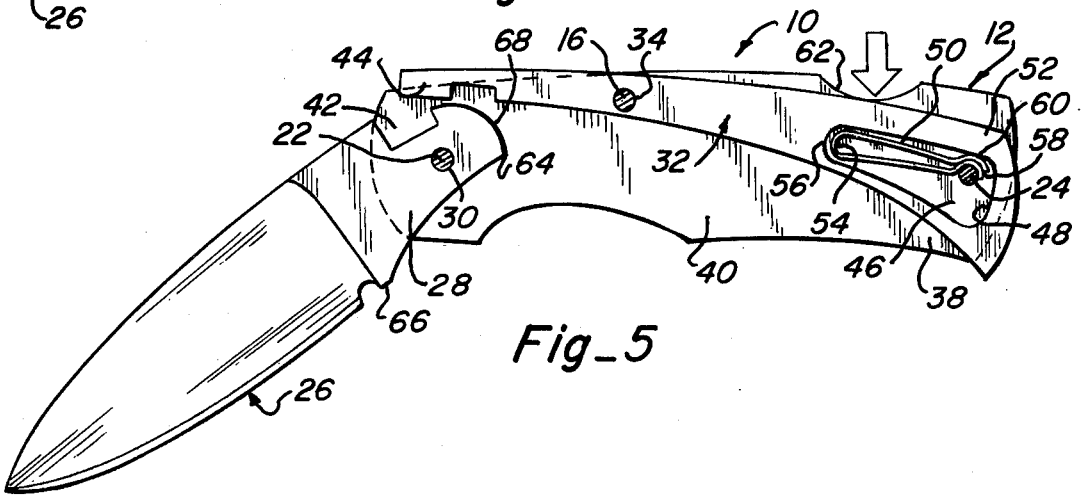
FIG. 5 is a view similar to FIG. 4 with the arm in release position and the blade partially retracted.

In FIGS. 3, 4, and 5 the knife is shown with one side scale, one side cover, and the bolsters on one side removed, and with the blade in retracted, extended, and partially retracted position. The tang 28 is formed with a key notch 42 and the forward end of rocker arm 32 is formed with a locking key 44 to engage in notch 42 when the blade is fully extended. As may be seen in FIG. 4 the key fits squarely in the notch with the blade in this position and takes the turning moment of the blade toward closing position in full tension. Thus the blade cannot be accidentally closed in the absence of material failure, and the knife is as safe for use as a fixed blade knife.

Rocker arm 32 is made of rigid rather than elastic material and thus acts as a locking beam rather than a spring. Therefore, means must be provided to produce a spring biasing action to normally hold the rocker arm in locking position. For this purpose the deep aft portion of the arm is formed with an aperture 46 having a peripheral wall 48, and is so located that the aft end pin 24 passes through it. Since the arm is a snug sliding fit with the side walls of channel 40, the side scales and peripheral wall 48 cooperate to produce a totally enclosed pocket which excludes all types of debris. The aperture is in the general form of a long narrow triangle with its base adjacent the aft end of the arm, and pin 24 is close to the base and also close to one wall of the triangle to serve as an abutment for the spring 50.

Biasing spring 50 is loosely mounted in the pocket. It may take any of various forms such as a coil spring or a straight length of wire or leaf spring engaging pin 24 and peripheral wall 48 in a manner to urge the aft portion 52 of the arm outward. However, it is presently preferred to use the spring shown, which may be a length of wire or leaf spring material bent into a V-shape as shown, with its acute end 54 adjacent to the peak 56 of the triangle. One free end 58 is arcuately formed to partially wrap around pin 24 as an anchorage and the other free end 60 is arcuately formed to define a protuberance to engage the peripheral wall 48. The spring thus applies its biasing force to the arm adjacent to its extreme aft end to obtain maximum leverage. Also the center pin 34 is located well forward of the transverse centerline of the handle to further increase the locking leverage. A recess 62 is formed in the aft portion of the back of the handle to facilitate pressing the aft portion of the arm inwardly.

When the blade is retracted as seen in FIG. 3, spring 50 yieldingly urges the aft portion of arm 52 outwardly and hence the forward portion inwardly so that it engages the cam end 64 and the kick 66 of the tang to hold the blade in the channel but with its sharp edge out of contact with arm 32. As the blade is pulled out of the channel the cam 68 pushes key 44 outward, rotating the arm and compressing spring 50. When the blade reaches the fully extended position, spring 50 forces key 44 into notch 42 and the blade is locked, as seen in FIG. 4. When it is desired to retract the blade the thumb is applied to the arm in the direction of the arrow in FIG. 5 and moved into recess 62, compressing the spring and swinging key 44 out of notch 42 to release the blade.

The rocker arm is so dimensioned and mounted that when it is in locking or non-locking position with the blade fully extended or fully retracted its outer edge is substantially flush with the back of the handle, and preferably continues to the extreme aft end, around the back and down to the front, flush with the side scales and bolsters, presenting a neat uncluttered appearance like a conventional non-locking pocket knife, and presenting no gaps or projections in the handle to catch dirt or clothing, or to scratch the hands of a user.

An important advantage of the construction disclosed is improved efficiency and cost. The spring does not have to be physically attached to any other part and it rides freely in the pocket. Since the spring is a separate component it can be designed and made for its function only, without consideration of appearance, and the best material and heat treatment can be selected independently of the manufacturing problems of any of the other components.

I claim:

1. A locking blade knife comprising:

a handle including a pair of side scales arranged in spaced parallelism to provide between them an elongate narrow channel to receive a knife blade and a locking rocker arm, and secured in fixed relation by a center pin and a pair of end pins;

a knife blade having an apertured tang pivotally mounted on the end pin at the forward portion of the handle to provide for swinging of the blade between extended operating position and retracted position in this channel;

the back of the tang being formed with a key notch to receive a locking key for positively retaining the blade in extended position;

a locking rocker arm arranged in the channel and extending along the back of the handle throughout the major portion of the length of the handle and pivotally mounted intermediate its ends on the center pin for rocking movement in the handle;

the forward end of the rocker arm being formed with an inwardly facing key to engage the key notch when the blade is in extended position and lock the blade against retraction;

the aft portion of the rocker arm being formed with an aperture of predetermined size and shape throughout the thickness of the arm and so located that the aft end pin passes through it to serve as a fixed abutment anchorages;

the rocker arm being dimensioned in thickness to fit in sliding relation with the side scales to produce between the scales and the periphery of the aperture a totally enclosed pocket;

and a spring located in the pocket and engaging the anchorage and the arm to yieldingly urge the aft end of the arm in a direction outwardly of the back of the handle to force the key into locking engagement with the notch.

2. A knife as claimed in claim 1; in which the rocker arm in locking and non-locking position is so dimensioned and mounted that its outer edge is substantially flush with the back of the handle;

and a recess is formed in the aft portion of the back of the handle to facilitate pressing the aft portion of the rocker arm inwardly against the spring bias to release the extended blade for retraction.

3. A knife as claimed in claim 1; in which the rocker arm extends to the extreme aft end of the handle and its aft end is substantially flush with the aft ends of the side scales to define the contour of the aft end of the handle.

4. A knife as claimed in claim 1; in which the spring is a slender elongate member of resilient material having one end engaging the anchorage and the other end engaging the rocker arm.

5. A knife as claimed in claim 4; in which the spring is a leaf spring.

6. A knife as claimed in claim 1; in which the rocker arm is rigid, the center pin pivot mount for the arm is well forward of the transverse centerline of the handle, and the point of application of the spring bias to the rocker arm is substantially at the aft end of the handle to increase the locking leverage.

7. A knife as claimed in claim 1; in which the pocket-forming aperture is in the general form of a long narrow triangle with its base adjacent to the aft end of the arm and with the end pin adjacent to the base;

and the spring is V-shaped with its acute end adjacent to the peak of the triangle and its free ends engaging the end pin and the aperture wall.

8. A knife as claimed in claim 7; in which one free end of the spring has an arcuate configuration to partially wrap around the end pin.

9. A knife as claimed in claim 7; in which the spring is a leaf spring.

* * * * *